US006494558B1

(12) United States Patent
Doval et al.

(10) Patent No.: US 6,494,558 B1
(45) **Date of Patent: *Dec. 17, 2002**

(54) COMPENSATION FOR MARKING-POSITION ERRORS ALONG THE PEN-LENGTH DIRECTION, IN INKJET PRINTING

(75) Inventors: Jose Julio Doval, Escondido, CA (US); Albert Serra, Barcelona; Francesc Subirada, Sant Cugat del Valles, both of (ES)

(73) Assignee: Hewlett-Packard Company, Fort Collins, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/693,524

(22) Filed: Oct. 20, 2000

Related U.S. Application Data

(63) Continuation of application No. 09/034,723, filed on Mar. 4, 1998, now Pat. No. 6,196,652.
(60) Provisional application No. 60/179,383, filed on Jan. 31, 2000.

(51) Int. Cl.[7] ..... B41J 2/01

(52) U.S. Cl. ..... 347/19
(58) Field of Search ..... 347/12, 19, 37, 347/40; 358/504, 406; 400/74

(56) References Cited

U.S. PATENT DOCUMENTS 5,796,414 A * 8/1998 Sievert et al. ..... 347/19
5,835,108 A * 11/1998 Beauchamp et al. ..... 347/19
6,161,914 A * 12/2000 Haselby ..... 347/19

OTHER PUBLICATIONS

HP DesignJet 2500/2000CP Printer, User's Guide pp. 5–8, 5–9, and 5–10.

* cited by examiner

*Primary Examiner*—Craig A. Hallacher
(74) *Attorney, Agent, or Firm*—Ashen & Lippman

(57) ABSTRACT

A calibration technique, for a printer having a plurality of different color ink printheads, which includes printing and scanning a test pattern. The test pattern is printed by each printhead printing a plurality of swaths having a length and distanced apart from each other. An optical sensor is used to scan the printed test pattern. Calibration is performed for each head by reading the swath length and the relative spacing of the swath and comparing the length to the spacing. This comparison is used to find the directional error for each head.

10 Claims, 10 Drawing Sheets

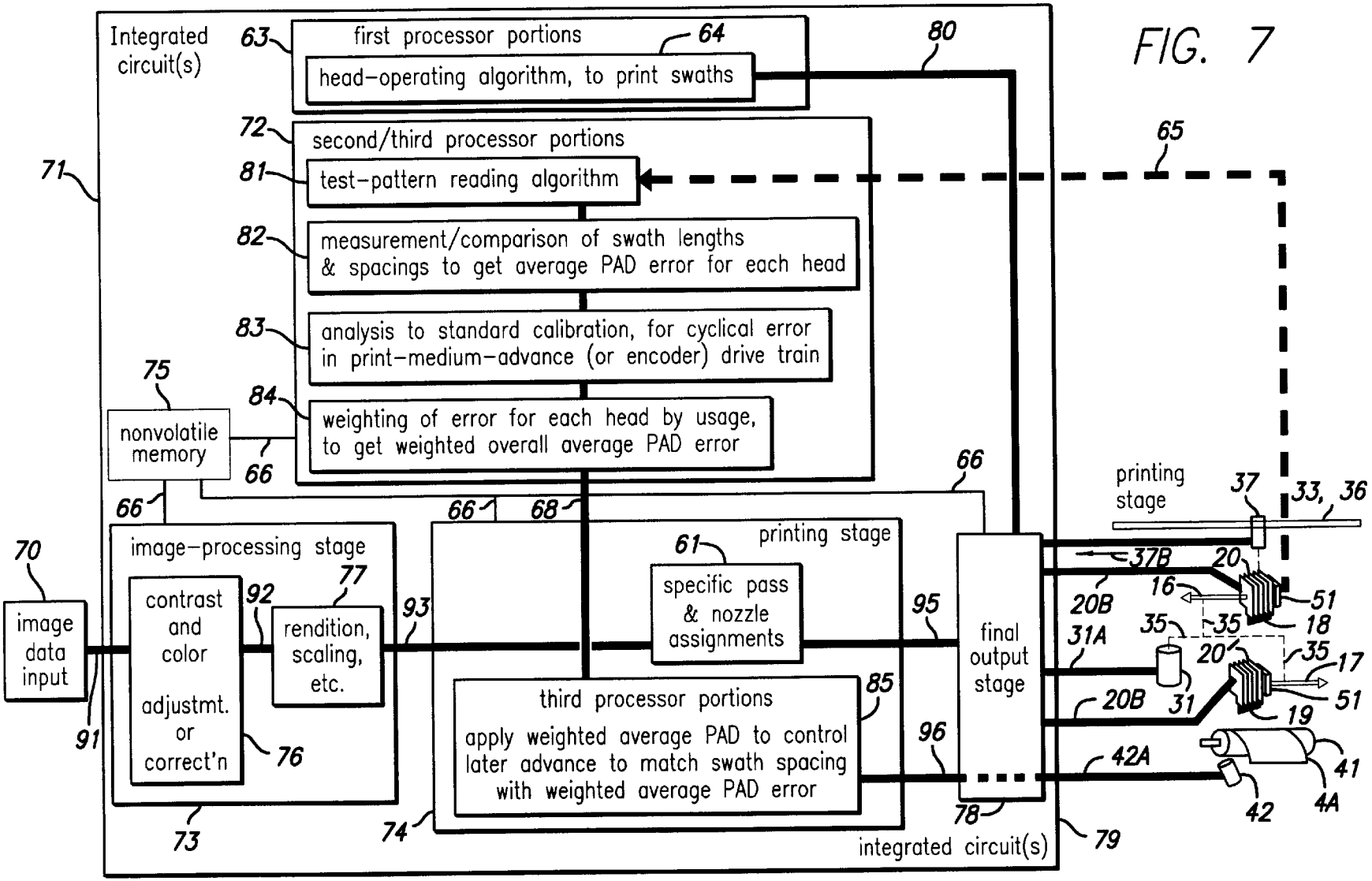
FIG. 7
printing stage
final output stage
integrated circuit(s)
first processor portions
head-operating algorithm, to print swaths
second/third processor portions
test-pattern reading algorithm
measurement/comparison of swath lengths & spacings to get average PAD error for each head
analysis to standard calibration, for cyclical error in print-medium-advance (or encoder) drive train
weighting of error for each head by usage, to get weighted overall average PAD error
printing stage
specific pass & nozzle assignments
third processor portions
apply weighted average PAD to control later advance to match swath spacing with weighted average PAD error
image-processing stage
rendition, scaling, etc.
contrast and color adjustmt. or correct'n
nonvolatile memory
Integrated circuit(s)
image data input

COMPENSATION FOR MARKING-POSITION ERRORS ALONG THE PEN-LENGTH DIRECTION, IN INKJET PRINTING

RELATED PATENT DOCUMENTS

A related document is another, coowned and U.S. utility-patent application Ser. No. 09/034,723, filed in the United States Patent and Trademark Office in the names of Francesc Subirada et al. on Mar. 4, 1998, with the title "SCANNING AN INKJET TEST PATTERN FOR DIFFERENT CALIBRATION ADJUSTMENTS" and subsequently issued as U.S. Pat. No. 6,196,652. It is wholly incorporated by reference into this present document.

This document is based on and claims the priority benefit of copending provisional application Ser. No. 60/179,383 filing Jan. 31, 2000, and a continuation of copending non-provisional application Ser. No. 09/034,723, filed Mar. 4, 1998.

FIELD OF THE INVENTION

This invention relates generally to incremental printing, with transversely scanning printheads, onto a printing medium that is also advanced along a longitudinal axis—and more particularly to marking-position errors in the printing-medium-advance axis. These errors are particularly important in that they create perceptible and in some cases conspicuous defects in printed images.

BACKGROUND OF THE INVENTION (a) The printer mechanism—The invention is amenable to implementation in a great variety of products. It can be embodied in a printer/plotter that includes a main case 1 (FIG. 1) with a window 2, and a left-hand pod 3 which encloses one end of the chassis. Within that enclosure are carriage-support and—drive mechanics and one end of the printing-medium advance mechanism, as well as a pen-refill station with supplemental ink cartridges.

The printer/plotter also includes a printing-medium roll cover 4, and a receiving bin 5 for lengths or sheets of printing medium on which images have been formed, and which have been ejected from the machine. A bottom brace and storage shelf 6 spans the legs which support the two ends of the case 1.

Just above the print-medium cover 4 is an entry slot 7 for receipt of continuous lengths of printing medium 4. Also included are a lever 8 for control of the gripping of the print medium by the machine.

A front-panel display 11 and controls 12 are mounted in the skin of the right-hand pod 13. That pod encloses the right end of the carriage mechanics and of the medium advance mechanism, and also a printhead cleaning station. Near the bottom of the right-hand pod for readiest access is a standby switch 14.

Within the case 1 and pods 3, 13 a cylindrical platen 41 (FIG. 2)—driven by a motor 42, worm 43 and worm gear 44 under control of signals from a digital electronic processor—rotates to drive sheets or lengths of printing medium 4A in a medium-advance direction. Print medium 4A is thereby drawn out of the print-medium roll cover 4.

Meanwhile a pen-holding carriage assembly 20 carries pens back and forth across the printing medium, along a scanning track—perpendicular to the medium-advance direction—while the pens eject ink. The medium 4A thus receives inkdrops for formation of a desired image, and is ejected into the print-medium bin 5.

As indicated in the drawing, the image may be a test pattern of numerous color patches or swatches 56, for reading by an optical sensor to generate calibration data. For present purposes, such test patterns are for use in detecting positioning errors.

A small automatic optoelectronic sensor 51 rides with the pens on the carriage and is directed downward to obtain data about pen condition (nozzle firing volume and direction, and interpen alignment). The sensor 51 can readily perform optical measurements 65, 81, 82 (FIG. 7); suitable algorithmic control 82 is well within the skill of the art, and may be guided by the discussions in the present document.

A very finely graduated encoder strip 36 is extended taut along the scanning path of the carriage assembly 20 and read by another, very small automatic optoelectronic sensor 37 to provide position and speed information 37B for the microprocessor. One advantageous location for the encoder strip 36 is immediately behind the pens.

A currently preferred position for the encoder strip 33 (FIG. 3), however, is near the rear of the pen-carriage tray—remote from the space into which a user's hands are inserted for servicing of the pen refill cartridges. For either position, the sensor 37 is disposed with its optical beam passing through orifices or transparent portions of a scale formed in the strip.

The pen-carriage assembly 20 is driven in reciprocation by a motor 31—along dual support and guide rails 32, 34—through the intermediary of a drive belt 35. The motor 31 is under the control of signals from the digital processor.

Naturally the pen-carriage assembly includes a forward bay structure 22 for pens—preferably at least four pens 23–26 holding ink of four different colors respectively. Most typically the inks are yellow in the left-most pen 23, then cyan 24, magenta 25 and black 26.

Another increasingly common system, however, has inks of different colors that are actually different dilutions for one or more common chromatic colors, in the several pens. Thus different dilutions of black may be in the several pens 23–26. As a practical matter, both plural-chromatic-color and plural-black pens may be in a single printer, either in a common carriage or plural carriages.

Also included in the pen-carriage assembly 20 is a rear tray 21 carrying various electronics. The colorimeter carriage too has a rear tray or extension 53 (FIG. 3), with a step 54 to clear the drive cables 35.

FIGS. 1 through 3 most specifically represent a system such as the Hewlett Packard printer/plotter model "DesignJet 2000CP", which does not include the present invention. These drawings, however, also illustrate certain embodiments of the invention, and—with certain detailed differences mentioned below—a printer/plotter that includes preferred embodiments of the invention.

(b) Relatively direct PAD-derived banding—In the images produced by a printer of this type, defects called "banding" appear where unprinted, lightly printed, or double-printed pixel rows occur repetitively. Relatively direct sources of such errors include:

- Print-medium-Axis Directionality or Pen-Axis Directionality "PAD" (FIG. 4), i.e. an angling of inkdrop trajectories particularly near the ends of the nozzle array 12,
- variations ΔPAD in the latter error,
- variations ΔPH in the pen height above the printing medium, and
- rotation $\theta_z$ of a printhead about the pen-to-print-medium axis z.

A dominant error source is PAD, which may be seen as analogous to camber. It can be either inboard or outboard.

It operates through the height PH of a pen above the print medium—including the height variations ΔPH—to extend or contract the swath length 14 in the pen-length direction on the printing medium, the so-called "paper swath length".

(In this document the term "height" is reserved for actual vertical height of the pen above the medium; hence the dimension of the swath in the long dimension of the medium, though commonly called "swath height", is here instead termed "swath length". Please do not confuse this dimension with the width of the swath, i.e. its dimension transversely across the medium in the carriage-scan axis.)

To reduce visible banding, operating strategies can compensate for such extension or contraction by a matching extension or contraction of the printing-medium-advance stroke. In other words, unprinted or double-printed pixel rows can be avoided by matching the stroke to the actual swath length.

This may be regarded as "compensation", though in a sense it is the opposite—namely, accommodation—and actually results in image deformation. Both the actual swath length and its matched stroke are different from the nominal swath length that constitutes a basic unit of the image.

Small resulting differences in shapes within an image can sometimes be detected. Accumulated differences due to such deformation can be seen as variation of overall printed image length.

The drawing shows a platen of the roller type, with print medium wrapped around the roller. In this geometry, swath-length extension is aggravated by the fact that the print-medium surface progressively recedes from the nozzle array 12 at all points off-axis relative to the pen-to-medium axis z.

This aggravating effect, in turn, is greatly complicated by any departure of the roller and printing-medium surfaces from nominal conditions, still relatively direct:

radius error Δradius from the nominal, thickness of the printing medium, or difference of that thickness from any assumed nominal thickness, runout or out-of-round, i.e. departure of the platen from circularity, and eccentricity of the platen relative to the pen-to-medium axis z, and any difference Δeccentricity of that eccentricity from any assumed nominal eccentricity.

The aggravating curved-platen effect itself is still relatively direct, though present only if the system prints on a curved platen 13, such as a roller.

These factors, except for printing-medium thickness variation, are already corrected in factory calibration of the printing-medium advance mechanism. What is particularly problematic is that in a representative product this calibration is inoperative when the system runs in a test-pattern measuring mode.

Hence a test pattern for measuring or accommodating PAD is printed with the advance mechanism calibrated but measured with the mechanism uncalibrated. The resulting measurement of PAD is accordingly imperfect.

The drawing shows the printing medium wrapping around the roller at both ends of the swath (or to left and right as illustrated). In some systems the medium may wrap for example behind the platen but not in front—still further complicating the overall effect on printed swath length.

In present systems of the greatest accuracy, however, such as precision plotters (as distinguished from systems for printing photograph-like images, or other display graphics), printing is instead on a flat platen. The platen may be formed as a vacuum bed to pull the printing medium into intimate contact.

Hence in such systems the receding-surface contribution is absent. Even if the platen is flat, however, PAD nevertheless directly alters the paper swath length.

(c) Relatively indirect PAD errors—Furthermore, even if the platen is flat the paper is typically driven by one or more rotary elements such as pinch wheels (not shown), gears 44 (FIG. 2) and worms 43, and so on. Radius error, runout and eccentricities of each of these elements also contribute to error of relative positioning as between the pen and the printing medium.

Depending on their positions in the mechanism relative to the print-medium drive motor, the encoder, and the medium itself (FIG. 5), conceptually these various kinds of devices can introduce mechanical errors of three different types. These types may be effective only as between the encoder and medium, or between the motor considered together with the encoder and the medium, etc.

These relationships require careful consideration in the design of any system for measuring error with an eye to accommodating its effects, as everyone who is skilled in this field can appreciate upon studying the drawing. Once again, in a representative printer/plotter these errors are corrected by factory calibration that is operative and effective when the machine is printing, and even when it is printing a test pattern—but not when it is measuring that same test pattern. Consequently the measurement and accommodation of PAD is rendered difficult or inaccurate.

These additional error sources can be regarded as less direct. They can only affect overall position of an entire swath, along the pen-length direction, rather than affecting the length of the pattern.

These sources of error can nevertheless be particularly insidious and troublesome. They are highly variable from one machine to the next—arising as they do from fabrication tolerances in individual components.

Earlier systems for dealing with PAD problems, and the related ones discussed above, include provisions in the printer/plotter line of the Hewlett Packard Company, particularly for example the previously mentioned model known as the DesignJet 2000CP. It is a tool that is especially optimized for graphic-arts applications.

(d) Deformation of image elements, and alteration of overall image-length—As noted above, earlier systems also have produced printouts that are troublesome to users who require overall page or image to be accurately a nominal length - - - or that picture elements within an image be accurately a nominal aspect ratio.

In earlier systems the only available remedy, for such users, is to switch off the PAD-factor accommodation entirely. The result is a Hobson's choice between banding and image dimensional inaccuracy.

(e) Varying functional requirements—A limitation of the PAD accommodations practiced heretofore is the capability to investigate and match PAD phenomena with respect to only one characteristic. That characteristic, typically, is overall extension of the effective pen foot-print as defined by measurement using a particular group of end nozzles.

First, for certain kinds of images, characterization of the PAD error even by particular blocks of an established test pattern may not correct the banding artifacts that actually occur. Second, specific pens may exhibit longitudinal PAD profiles that differ greatly from the simple end-camber characteristic suggested by FIG. 4.

Third, pen PAD properties—even for given pens—are far from consistent under various nozzle-firing conditions, and the state of the art has not examined the opportunities to select firing properties tailored to a particular requirement.

For instance it may be advantageous to use one PAD measurement-and-correction model for one printmode, and another model for a different print-mode.

Similarly, pen directionality is different with different firing frequencies. The stability of pen directionality is greater at some frequencies than others.

Prior PAD measurement techniques have failed to provide means for investigating these conditions for a particular image or type of image.

(f) Conclusion—These limitations have continued to impede achievement of uniformly excellent inkjet printing—at high throughput—on all industrially important printing media. Thus important aspects of the technology used in the field of the invention remain amenable to useful refinement.

SUMMARY OF THE DISCLOSURE

The present invention introduces such refinement. In its preferred embodiments, the present invention has several aspects or facets that can be used independently, although they are preferably employed together to optimize their benefits. These facets are set forth in the appended claims.

All of their operational principles and advantages of the present invention will be more fully appreciated upon consideration of the following detailed description, with reference to the appended drawings, of which:

BRIEF DESCRIPTION OF THE DRAWINGS

FIG. 7 is another schematic block diagram, focusing upon the functional blocks within the program-performing circuits of the preferred embodiment;

DETAILED DESCRIPTION OF PREFERRED EMBODIMENTS

Figure 1:
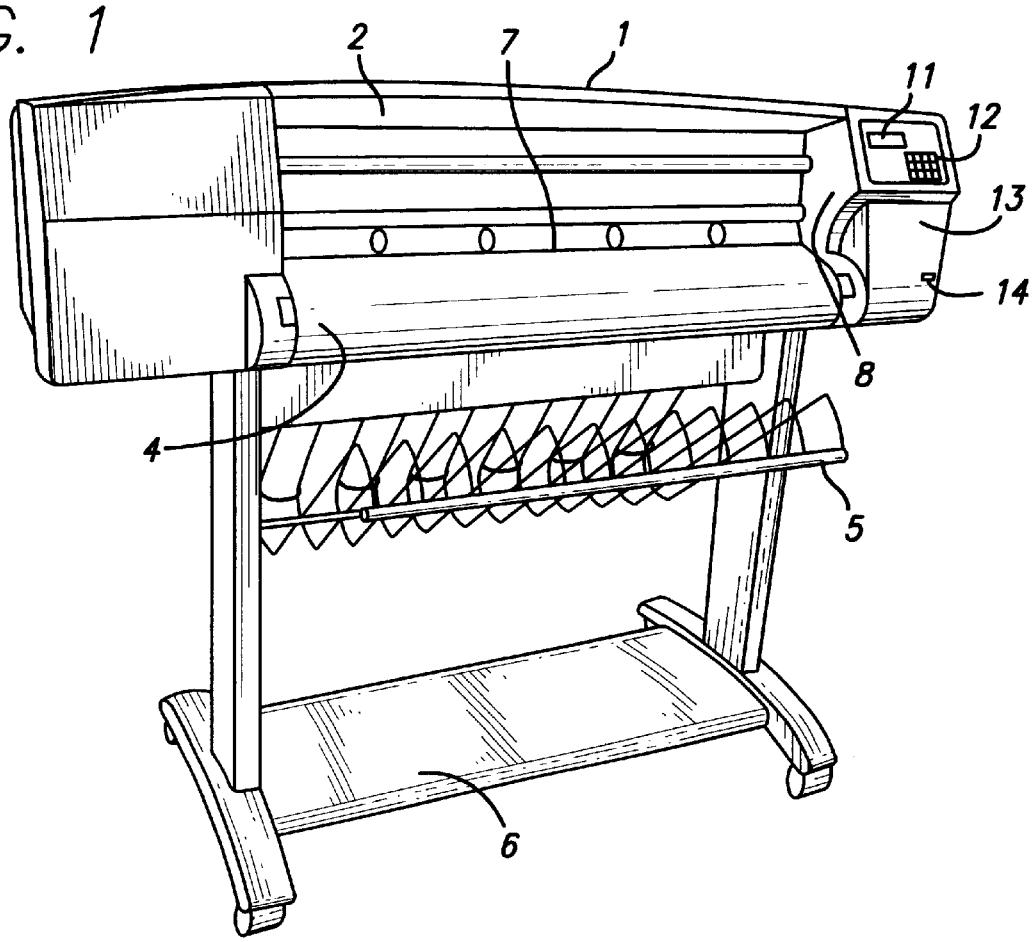
FIG. 1 is a perspective or isometric view of a printer/plotter that is and that incorporates a preferred embodiment of the invention.

Preferred embodiments of the present invention aim to minimize the appearance of all banding errors, by careful measurement followed by provision of matching variations in the printing-medium advance stroke. When image deformation (e.g. overall lengthening or shortening) is comparable in importance with banding artifacts, these strategies should be used with care if at all.

Principal differences relative to earlier approaches are in measurement technique and the focus of this invention upon the cyclical phenomena just mentioned. Through use of matching variations in medium advance, the invention accommodates error sources of three types that can contribute to banding: media, pen, and printer.

The errors are measured by printing a test pattern and using it to gauge the length of the printed swath; subsequently, the printing-medium advance is managed accordingly. This document is divided into six sections: first, a description of the measurement pattern; second, a description of the measurement process; third, the application of the measured value; and fourth through sixth, additional discussion of precision and accuracy.

1. The Test Pattern

Preferably the pattern (FIG. 6) used for this invention is the same as one used for vertical pen-to-pen alignment. There are two columns for every color, each column having four swaths, and each swath containing five printed blocks. Commonly each block is printed in black K or one of the three subtractive primary colors cyan C, magenta M and yellow Y.

The middle block is always printed with the magenta pen and serves as the reference block for pen-to-pen alignment. This block also serves to gauge residual measurement error, which will be explained later.

In a preferred pattern, the end blocks are printed at 12 kHz using the extreme printable nozzles of the pen. In an exemplary 512-nozzle pen, these are nozzles 1 through 36 for the top block and nozzles 476 through 512 for the bottom block.

The blocks are equally spaced throughout the swath with a periodicity of 119 pixel rows or "dot rows" (DR)—i.e., pixel rows. (Changes in printmode can affect selection of the nozzles used to print the end blocks; for instance tests have been run using blocks of nozzles 41–76 and 449–484, with a periodicity of 102 DR printed at 6 kHz.)

In its later stages of automatic measurement and analysis, the invention makes use of an essentially straightforward algorithm to find the centroids of the blocks, and these centroids are made the reference points for all subsequent calculations. Constraints inherent in this algorithm require that in the preliminary printing stage the blocks be equally spaced.

Some pens, such as the printheads (80-C4820 series) used for the present invention, have an irregular PAD profile. For such heads, the choice of nozzles for the end blocks can cause differing banding results; therefore care should be taken in selecting nozzles for this purpose.

In preferred and representative embodiments, the test pattern is printed using essentially the normal operating mode of the machine. In this mode, drive signals to the print-medium advance motor vary according to a calibration function developed at the factory for the same individual machine.

This calibration is specifically programmed into the system to produce correct print-medium displacements considering the actual starting point and desired ending point of the mechanism, for each displacement. Such operation is necessary because the calibration itself is not simply linear but rather reflects a complex of interactions between several different influences, some of which vary through the operating range.

This operating mode is extremely effective for point-to-point movements—the only kind of movement normally required in a swath-based printer, for stepping from swath to swath. Therefore the apparatus is able to produce an extremely accurate calibration pattern.

2. Measurement

The operating mode discussed above, however, is not able to automatically impose the factory calibration upon the mechanism during continuous operation to pass the entire test pattern under an optical sensor. The machine is capable of doing so in principle and has available all the calibration data that would be required for doing so, but no program for doing so has been provided.

Modifying the integrated circuit that operates the print-medium advance would represent an extremely costly major redesign. Therefore as will be seen the invention must make an extra step to correct the sensor readings for the calibration.

The overall strategy of measurement is to make two measurements using the same reference standard. One measurement is substantially internal to each swath respectively, and particularly examines the swath length defined as the distance between top and bottom block centroids in each swath.

These test-pattern end blocks respectively represent ink ejected from the top and bottom nozzles of each of the four pens in use. Therefore if those nozzles are mispointed (contain PAD), these blocks are mutually mispositioned—and this first measurement, the internal measurement, reflects the PAD error with the effects of print-medium thickness and traction against its drive elements.

The other measurement spans or straddles the boundary zone between two swaths—and nominally therefore disregards mispositioning of the end blocks within a single swath, relative to one another or relative to the central blocks. It examines only errors in relative positioning of the central or "reference" blocks.

Mutual spacing of the center blocks is defined by the distance between their centroids, as for the end blocks. Nominally the center blocks are formed by the center of the pen and for present purposes are not directly subject to large PAD errors—though they are subject to small errors due to the radial and cyclical sources discussed previously.

As mentioned above, the test pattern is printed with the print-medium advance calibrated, providing extremely accurate center-block-to-center-block positions; but measurements must be taken with the advance uncalibrated. Correction of the measurements for the radial and cyclical error sources will therefore be required.

In computer-code expressions below, the first measurement is represented by a variable "MeanUp2down[pen]". The second measurement is analogously represented by the variable "Center2Center".

Both of these measurements, according to preferred embodiments of the present invention, allow for the effects of the prior adjustment. Details of the measurements will now be discussed.

(a) PAD Factor Measurement for each Pen—This factor is a ratio of the actual distance between the end blocks in the test pattern and their theoretical distance. It thus represents a multiplicative error in the effective or apparent swath length—which can be matched by an adjusted printing-medium advance if desired.

The programming-code expressions used to calculate the PAD factor are (definitions will follow):

```
padFactor[pen]=(-MeanUp2down[pen]*CARRIAGE_
    RES*eusPerSample)/((marksInSwath-
    1)*pat.swathDef.distance*PAPER_RES)                a]

padFactor[pen]=padFactor[pen]*(mediaFactor)            b]

mediaFactor=(marksInSwath*pat.swathDef.distance*PAPER_
    RES)/(CARRIAGE_RES*eusPerSample*MeanCenter2center)c]
```

Of course it is understood by everyone in this field that these are commands, or statements of instruction, rather than statements of equality. This is perhaps most evident in expression "b]".

Combining the three expressions yields a simplified form as follows.

Figure 2:
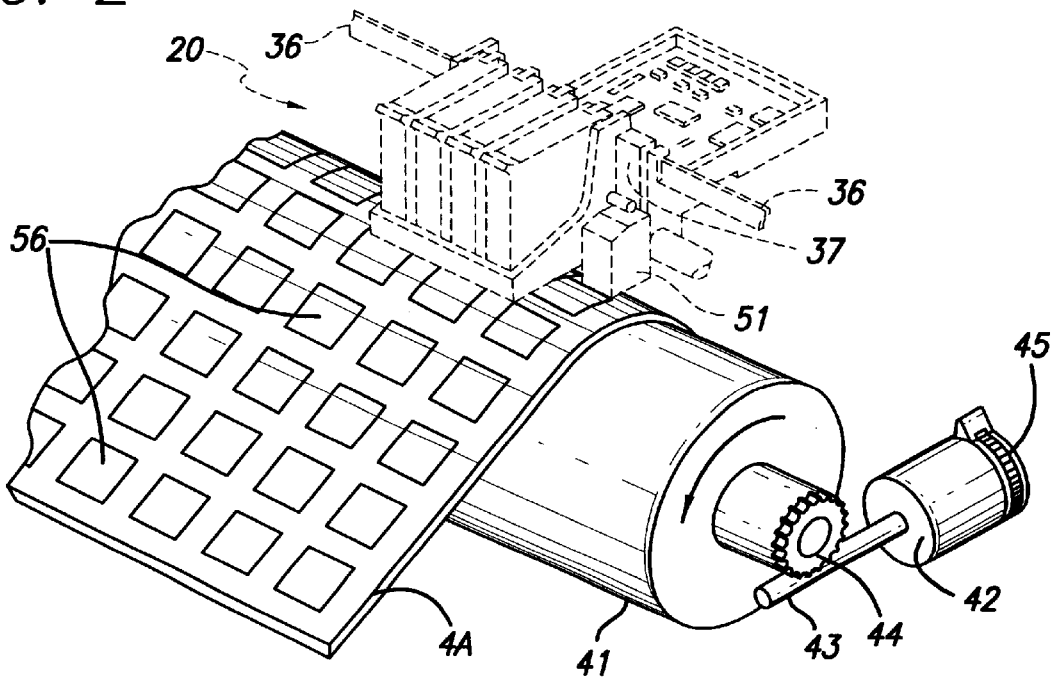
FIG. 2 is a like view, but enlarged, of portions of a printing engine—particularly including the printing-medium advance mechanism—within the FIG. 1 printer plotter.
Figure 3:
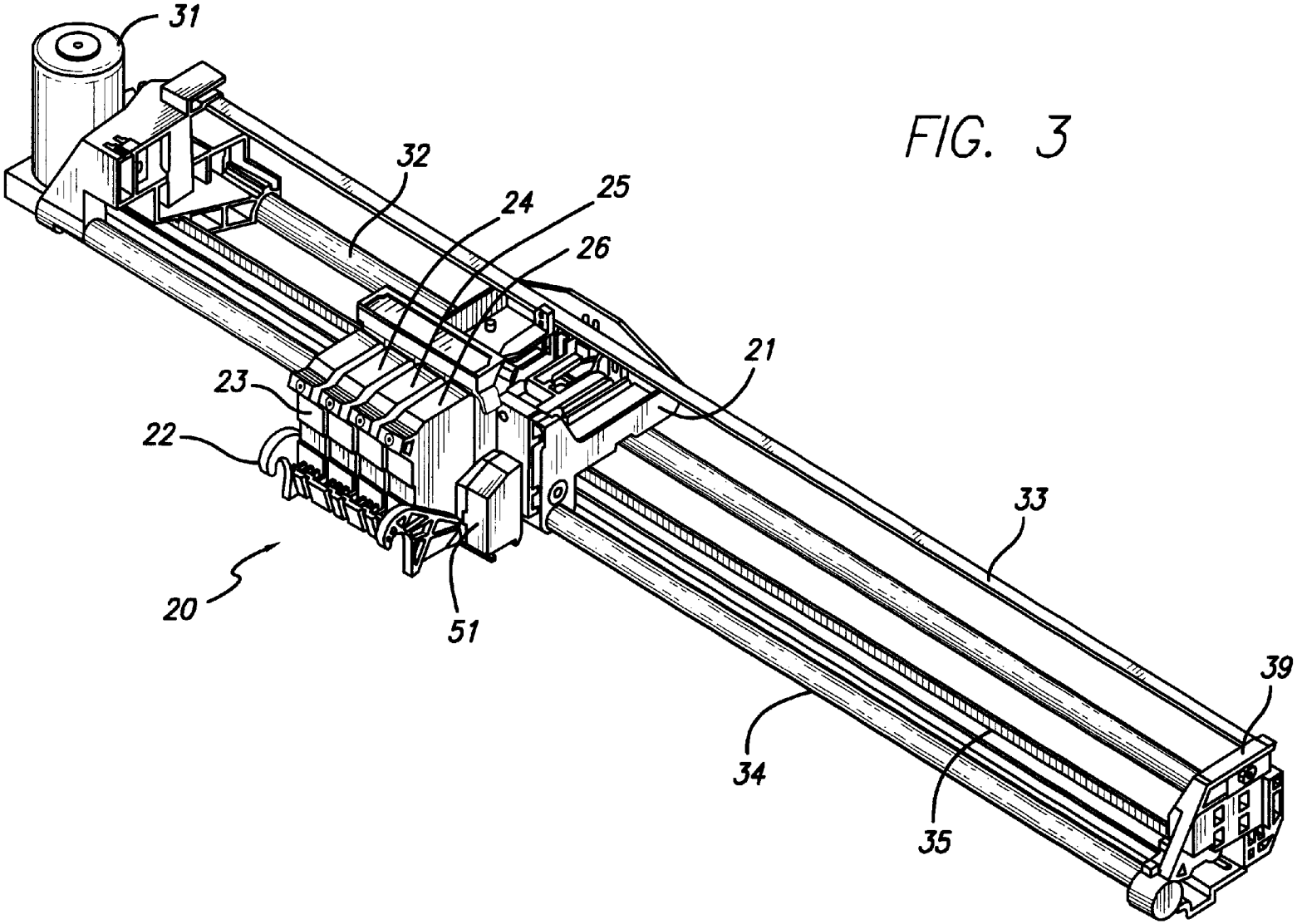
FIG. 3 is a like view, but somewhat less enlarged, of a bigger portion of the print engine.
Figure 4:
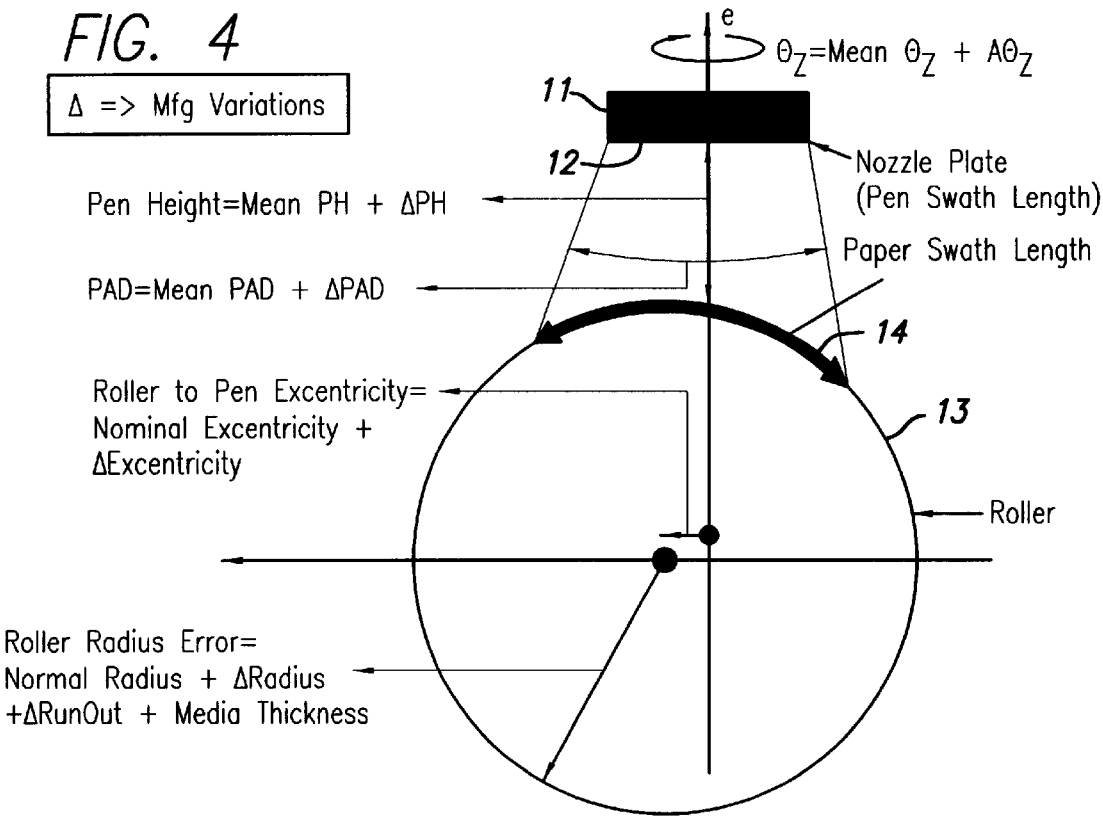
FIG. 4 is a geometrical diagram of relatively direct error sources within the FIGS. 2 and 3 engine, particularly relating to PAD pen error.
Figure 5:
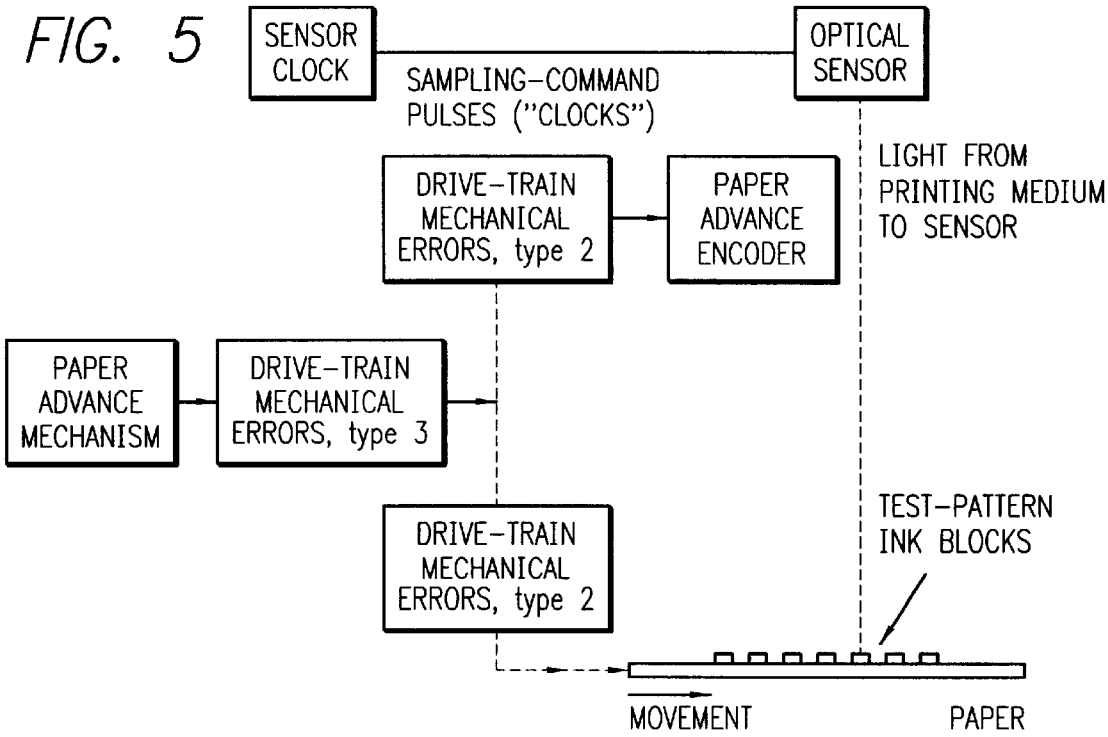
FIG. 5 is a much more schematic block diagram of the FIGS. 2 through 4 engine, showing relatively less-direct error sources.

```
padFactor[pen]=(-MeanUp2down[pen]*marksInSwath)/
    (MeanCenter2center*(marksInSwath-1))
```

where:

1. MeanUp2down[pen] is the mean distance between the end block centroids in the unit pattern. In FIG. 2, the eight Up2Down distances for the black pen are shown (as illustrated, the system uses distances between centroids of the top and bottom blocks). MeanUp2Down is the average of these eight distances. See the explanation below for how the values are corrected for PAD errors.

The units of measurement are "number of optical-sensor-clock sample pulses" or more simply "sensor-clock pulses"—or in electronics parlance just "clocks". The "clocks" are the units of measurement used initially, for expediency, by the optical sensor which reads the test pattern.

These units, however, do not bear a constant relationship to print-medium-axis encoder readings—which are more closely related to actual motion of the writing surface. Later in the procedure the measurement results are converted from these units into encoder units (EUs or encoder "ticks").

2. The CARRIAGE_RES variable, although labeled "carriage" resolution, actually is the number of pixel rows per unit distance—i.e., the nominal resolution in the pen-length or print-medium-advance dimension. It is 24 dots/mm (600 dots/inch) for preferred embodiments. (If scaled to dots per encoder unit or "tick", this value is equivalent to 600 dots/inch÷18,750 EU/inch=1/31.25 dot/EU, 1/31¼ row/tick).
3. eusPerSample represents the number of print-medium-advance axis encoder units per measurement sensor sample. It is a ratio of print-medium-axis encoder units or ticks (which track the movement of the media below the sensor) to sensor-clock pulses or "clocks" (which drive the sensor sampling process).

As the clocks are the measurement units used in reading the test pattern, and the encoder ticks more nearly represent a physical truth, this variable "eusPerSample" is a calibration factor (though expressed as a reciprocal, ticks per clock rather than clocks per tick).

It is a dynamically measured sensor calibration, calculated each time a measurement is made. In preferred embodiments, this factor is usually about 1.24 EU/sample (ticks/clock).

Multiplication of variables 1, 2, and 3 produces the actual distance between the end blocks, subject to a scaling factor.

If for instance CARRIAGE_RES is expressed in rows per tick, then the actual distance is in pixel rows.

4. marksInSwath is the number of-blocks in a given swath. In preferred embodiments there are five blocks as stated above.
5. pat.swathDef.distance ("pattern-swath defined distance") is the periodicity of the printed blocks within each swath of the test pattern. In preferred embodiments, there are 119 DR from block to block, e.g. from centroid to centroid, in the pattern.

Since the value of marksInSwath is five; the number of spaces between the marks is marksInSwath−1=4, and multiplying (marksInSwath −1)×pat.swathDef.distance (i.e. the periodic spacing) yields the theoretical distance, in pixel rows, between the centroids of the end blocks.

6. PAPER_RES is the resolution of the printing-medium-axis encoder, once again in encoder units (EU) or "ticks" per unit distance. The preferred embodiment has 18,750 EU per inch or 31.25 EU per DR (ticks/row).
7. mediaFactor is a gauge of the previously mentioned residual measurement error. (This name has been used in other systems for a very different variable.)
8. MeanCenter2center is the mean distance between the reference blocks of all the columns. This distance is corrected for PAD errors. In FIG. 1, the six Center2Center distances for the magenta pen are identified. MeanCenter2Center is the average of these six distances.

Expression "b]" provides a correction for the residual measurement errors induced by simplifications in correcting for PAD errors. Expression "c]" is the ratio of theoretical distance to actual distance of the reference blocks; naturally it must be adjusted to remove the effect of the ratio marksInSwath/(marksInSwath−1)=5/4.

Again, the blocks are printed with the advance-axis calibration activated, but the sensor readings are taken with that calibration disabled. Therefore the sensor samples will require a separate processing step of correction by the same calibration data.

In essence, this approach uses the ruler that was used to place the blocks at a distance to each other to measure the actual distance. In theory the ratio should always be one.

The residual error is introduced by the simplifications used in correcting the samples for medium-advance errors. They are as follows.

No iterations are performed when correcting for the samples. The medium-advance calibration requires at least one iteration for improved performance.

The samples are transformed to obtain a periodicity in the signal. This is done by interpolation, which adds error.

A representative value of mediaFactor is 0.9998. In comparison with past implementations this is quite close to unity. Using the mediaFactor in expression "b]" above tends to fine-tune the actual measurement.

(b) PAD error correction—The complexities of these measurements play out when it is considered how the test-pattern blocks are formed and measured. As mentioned earlier, they are printed with the medium-axis calibration activated: this affects all the distances between blocks.

The patterns are then scanned with the line sensor. The raw sensor readings (after conversion from sample clocks) are relative to the medium-axis encoder and are not initially corrected for the calibration; i.e., they do not account for mechanical variations in the paper path itself.

In order to have an equitable comparison, calibration corrections must be added to the measurement obtained by the line sensor. (An alternative way to make it equitable would be to subtract those errors from the theoretical value.)

The procedure used, in preferred embodiments, to correct the measurement encoder units is as follows.

1. The scan start location is used to calculate the first PAD error, which in the more-detailed presentation below will be called "error1".
2. The sensor-sample positional units (clocks) are converted to print-medium-axis encoder units (ticks) and then used to calculate the positional error of the sample, "error2".
3. With the use of the medium-axis calibration expression and the errors obtained above, the corrected sample encoder units (corrected ticks) are calculated.
4. These corrected positional encoder units must be transformed to equally spaced units so that the maximum of the blocks can be found. Interpolation is used to convert the corrected samples to equally spaced samples.

The arithmetic will clarify the process. It is presented below.

(c) PAD Calibration Model—An understanding of the print-medium-axis calibration expression will facilitate understanding of the compensation process. The medium-axis calibration expressions are as follows.

realAdvance=(error2−error1+idealAdvance)/(1.0−Slope) d]

error=wormAmplitude*(cos((2*PI*real_pos)/WORM_REVOLUTION+wormPhase)−cos(wormPhase))+ rollerAmplitude*(cos((2*PI*real_pos)/ROLLER_REVOLUTION+rollerPhase)−cos(rollerPhase))+ roller2Amplitude*(cos((2*2*PI*real_pos)/ROLLER_REVOLUTION+roller2Phase)−cos(roller2Phase)), e]

where:

1. realAdvance is the advance that must be taken to compensate for all PAD errors.
2. error1=the error at position 1 based on the error expression shown above.
3. error2=the error at position 2 based on the error expression shown above.

These errors depend only on the current position ("real_pos") and are due to imperfections in the mechanism causing cyclical errors.

4. idealAdvance is dictated by the print mode (16,000 EU for one pass, 8,000 EU for 2 passes, etc.).
5. real_pos=the current position of the system.
6. slope=the accommodation factor for roller diametral variations (i.e., smaller or larger), media thickness, and roller traction.

The PAD error accommodated by the slope depends on the length of the advance stroke—i.e., the larger the advance, the larger the accommodation. The error is independent of current position.

7. wormAmplitude=the amplitude of the sinusoidal error component produced by the eccentricity of the worm.
8. WORM REVOLUTION=the periodicity of that same sinusoidal error.
9. wormPhase=the phase of that same error.
10. rollerAmplitude=the amplitude of the sinusoidal error component produced by the eccentricity of the roller.
11. ROLLER_REVOLUTION=the periodicity of that same sinusoidal error.
12. rollerPhase=the phase of that same error.
13. roller2Amplitude=the amplitude of the sinusoidal error component produced by the cylindricity of the roller.
14. roller2Phase=the phase of that same error.

The above expressions are used to adjust for mechanical variations in the printing-medium drive train. The reason for including the current position of the roller (and other system components) and the "ideal advance" is that these inputs are needed in order to perform an accurate advance.

The error at the current position can be calculated using expression "e]". The error at the final position (i.e., after the advance) can be estimated by using the sum of the actual position and the ideal advance in expression "e]". With the use of expression "d]" an estimated real advance can be calculated.

Iteration is needed because of the initial use of an estimated real advance. With the sum of the estimated real advance and the current position, the error at the final position can be calculated. The error at the final position and the error at the current position can be used to calculate the final real advance, using expression "d]" a second time.

(d) Inverse Model for Measurement Correction—As can be seen from the above discussion of expressions d] and e], the print-medium-axis calibration expressions provide a real advance as a function of current position and ideal advance. Measurement as prescribed above provides the real advance needed to move from centroid to centroid of the blocks.

This should then be transformed to yield ideal advance as a function of real advance and actual position. The expression obtained is:

correctedSample=sampleDistToStart*(1.0−slope)−(error2−error1), f]

where "correctedSample" is the ideal advance and "sampleDistToStart" is the real advance.

As stated earlier, the location at which the scan starts is error1. Error2 is calculated for each sample using the distance to the start position. From this we obtain the corrected samples, expression f].

A linear interpolation of the corrected sample position is then performed to obtain equally spaced samples. For example, the following three vectors (tabulated below, from a functional relationship) will explain the process.

Vector A is the vector of uncorrected sensor samples: it corresponds to the end result in some earlier implementations without correction). Vector B is the vector of corrected sensor samples.

These values form an irregularly spaced sequence, due to the simple nature of the algorithm used to establish the block spacings. Vector C is the vector of equidistant corrected sensor samples.

| A Uncorrected | B Corrected | C Corrected & equidistant |
|---|---|---|
| 1 1024 | 1.2 1024 | 1 1024 |
| 2 900 | 1.9 900 | 2 895 |
| 3 850 | 3.0 850 | 3 850 |
| 4 800 | 4.1 800 | 4 805 |
| 5 750 | 4.9 750 | 5 754 |
| 6 800 | 6.1 800 | 6 796 |
| 7 850 | 6.9 650 | 7 856 |
| 8 900 | 8 900 | 8 900 |
| 9 1024 | 9.1 1024 | 9 1013 |

The "corrected and equidistant" samples are then introduced in the algorithm that calculates the position of the block centroids. As mentioned earlier, the reason for the interpolation is to obtain equidistant samples, because the algorithm used to find the block centroids (or maxima) requires equidistant samples.

3. Application

Using the above process, a PAD factor is obtained for each pen. This information is then used to calculate the PAD factor for the swath to be printed. The expression used is:

PADFactor=(swathDensity[PEN_BLACK]*penPADFactor[PEN_BLACK]+swathDensity[PEN_CYAN]*penPADFactor[PEN_CYAN]+swathDensity[PEN_MAGENTA]*penPADFactor[

PEN_MAGENTA]+swathDensity[PEN_YELLOW]*penPADFactor[PEN_YELLOW])/(swathDensity[PEN_BLACK]+swathDensity[PEN_CYAN]+swathDensity[PEN_MAGENTA]+swathDensity[PEN_YELLOW])

Each pen's swath density is estimated from the content of the swath buffer and the applicable print mode requirements. The PAD factor is then applied to the advance for the swath.

If the calculated PAD factor is greater than the limit that maintains line length accuracy, however, then that limiting maximum value is applied. A now-preferred limit is 35 $\mu$m, which corresponds to a PAD factor between 0.99835 and 1.00165; however, increase of the limit to 41 $\mu$m (PAD factor 0.99808 to 1.00192) is contemplated. This value results from reducing the line-length accuracy specification of 0.002 by the print-medium advance variation of the printer (0.000078 or 1.7 $\mu$m); thus 0.002−0.000078=0.00192.

The PAD factor is then used to compensate the "ideal" advance in the paper-axis calibration expression. That is, because of pen, media, and printer errors, the ideal advance must grow or shrink accordingly. The insertion of the PAD factor is as follows:

idealAdvance=idealAdvance*PADFactor

This ideal advance is then used in expression "d]" above to calculate the proper advance and thus optimize banding performance. As noted earlier, the advance is ideal in the sense that it matches the effective swath length, and somewhat at the expense of image-element length and shape accuracy.

4. Hardware and Program Implementations of the Invention

The general hardware context of the invention has already been discussed with reference to FIGS. 1 through 5. In a block diagrammatic showing, the pen-carriage assembly is represented separately at 20 (FIG. 7) when traveling to the left 16 while discharging ink 18, and at 20' when traveling to the right 17 while discharging ink 19. It will be understood that both 20 and 20' represent the same pen carriage.

The previously mentioned digital processor 71 provides control signals 20B to fire the pens with correct timing, coordinated with platen drive control signals 42A to the platen motor 42, and carriage drive control signals 31A to the carriage drive motor 31. The processor 91 develops these carriage drive signals 31A based partly upon information about the carriage speed and position derived from the encoder signals 37B provided by the encoder 37.

(In the block diagram all illustrated signals are flowing from left to right except the information 37B fed back from the sensor—as indicated by the associated leftward arrow.) The codestrip 33 thus enables formation of color inkdrops at ultrahigh precision during scanning of the carriage assembly 20 in each direction—i.e., either left to right (forward 20') or right to left (back 20).

New image data 70 are received 91 into an image-processing stage 73, which may conventionally include a contrast and color adjustment or correction module 76 and a rendition, scaling etc. module 77.

Information 93 passing from the image-processing modules next enters a printmasking module 74. This may include a generally conventional stage 61 for specific pass and nozzle assignments.

Swath-length adjustment stage 85 modifies 96 the advance-mechanism signals 42A in response to test-pattern reading 81 and processing 82–84. Associated with functions 82 and 84 is the ad hoc calibration 83 mentioned earlier, correcting for the same factors used in the standard factory calibration.

To make possible these various correction procedures 81–85, the system also includes provisions 64 for generating the test pattern. This is accomplished automatically through commands 80 to the final output stage, when adjustment is called for.

As is well known, the integrated circuits 71 may be part of the printer itself, as for example an application-specific integrated circuit (ASIC), or may be program data in a read-only memory (ROM)—or during operation may be parts of a programmed configuration of operating modules in the central processing unit (CPU) of a general-purpose computer that reads instructions from a hard drive.

Most commonly the circuits are shared among two or more of these kinds of devices. Most modernly, yet another alternative is a separate stand-alone product, such as for example a so-called "raster image processor" (RIP), used to avoid overcommitting either the computer or the printer.

Figure 6:
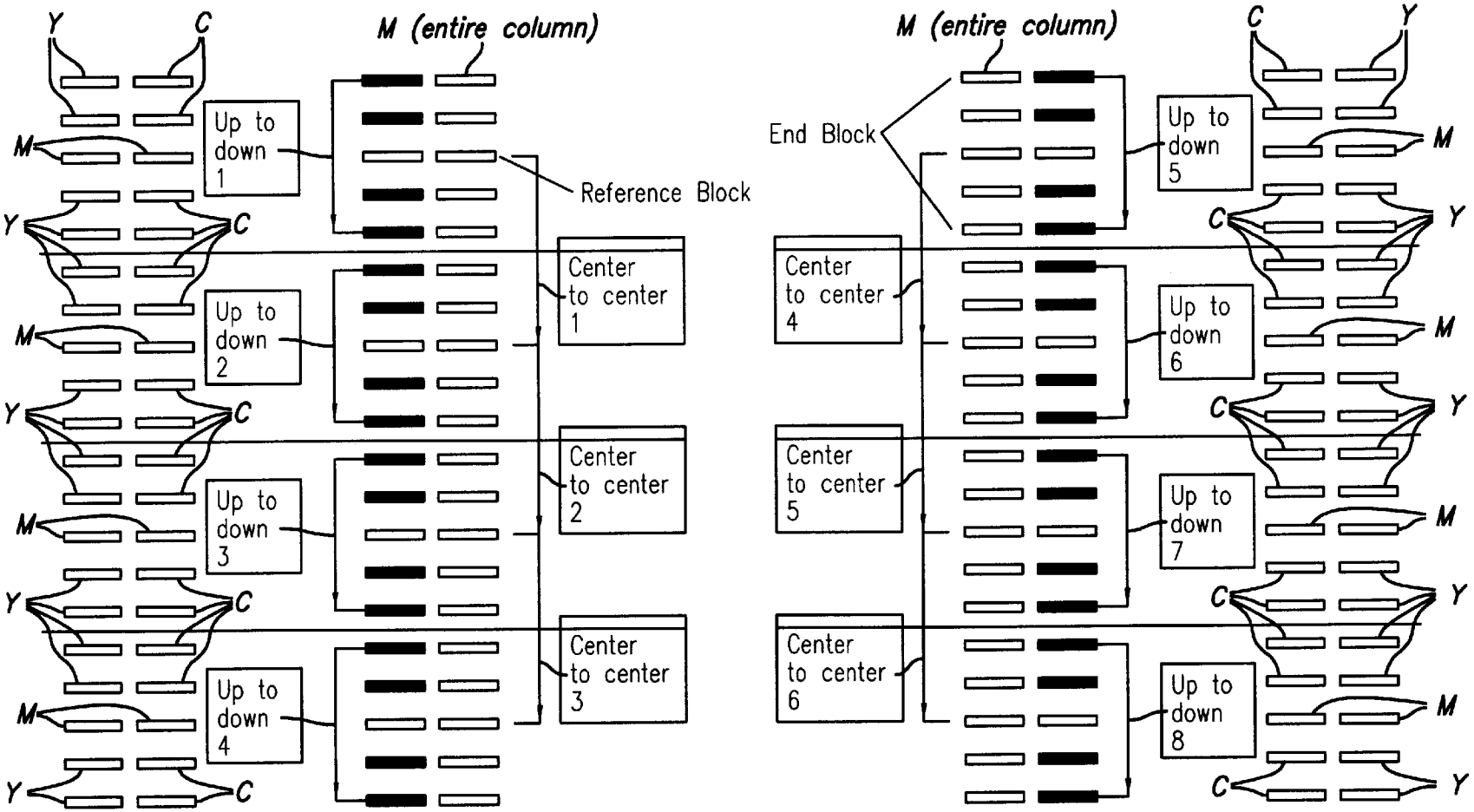
FIG. 6 is a color test pattern that is automatically printed and then read to determine directional errors in accordance with the invention.
Figure 8:
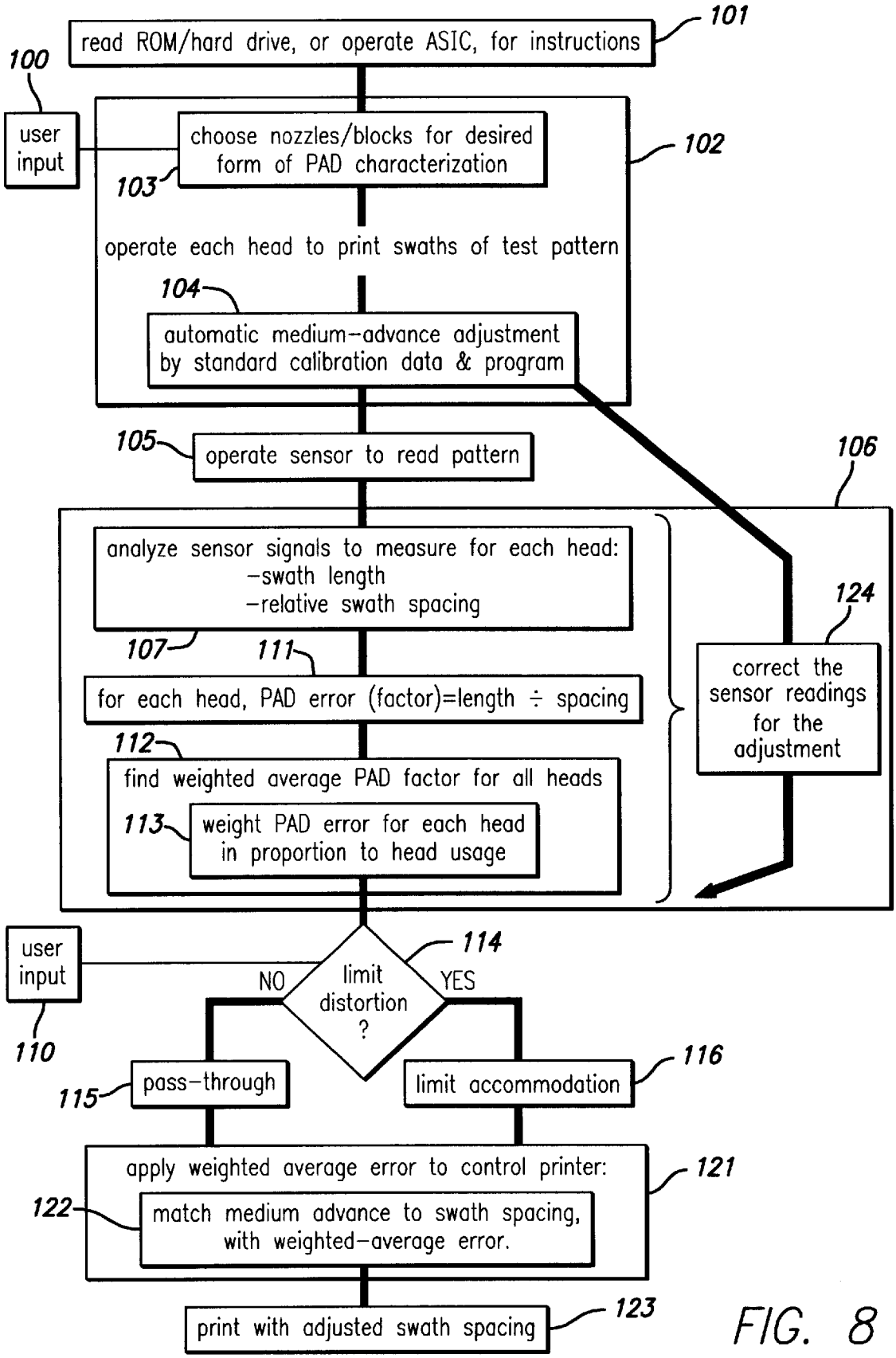
FIG. 8 is a program flow chart illustrating operation of preferred embodiments for some method aspects of the invention.

In operation the system retrieves 101 (FIG. 8) its operating program appropriately—i.e., by reading instructions from memory in case of a firmware or software implementation, or by simply operating dedicated hardware in case of an ASIC or like implementation. The first part of the procedure, when a new set of pens or new type of media is in use, is generation 102 of a new test pattern (FIG. 6).

If the system has been configured to permit variation 103 of test-pattern-generating nozzles or test-pattern blocks to select or control the properties of the PAD characterization desired, in accordance with this invention, then user inputs 100 can be entered to effectuate this option. These may take the form of a simple selection between two alternative characterizations.

Instead they may encompass any of a great variety of characterization parameters such as blocks to use in the analysis, nozzles to use in generating particular blocks, or higher-level selections such as type of PAD profile to be investigated—or combinations of these kinds of choices. Thus the analyzing and comparing steps can include selecting nozzles for use in printing blocks of the test pattern, or selecting blocks of said test pattern for use in analysis and comparison, to enable one or more operating option chosen from these:

- control of a PAD characteristic for use in defining how to accommodate pen-nozzle directionality,
- obtaining a PAD factor profile throughout length of a pen,
- obtaining a PAD factor profile to capture problematic behavior in a particular part of a pen,
- tailoring PAD adjustments to a desired printmode, and
- investigating pen operation at different frequencies or in different frequency ranges.

As part of the test-pattern printing process, the automatic calibration 104 built into the system is invoked and active during the printing. Complementing this step is the later correction 124 of sensor readings to agree with the calibration applied in printing.

Next the system proceeds to reading 105 of the pattern, and analysis 106, 107, 111–113 of signals generated in the reading. The calibration correction 124 may be associated with any or all of these steps.

Steps down through determination 111 of PAD factor, for each combination of pen (printhead) and printing medium, can be performed at any time prior to printing—and in fact can be performed as soon as a new combination of pens and media has been selected and installed. Determination of a duty-weighted overall factor, however, can only be performed when a particular image data file has been at least partially read—and for greatest convenience may be best reserved for performance during actual printing of the corresponding image, as for instance calculation of one swath at a time.

If the system has been configured to permit limitation of distortion introduced by the PAD accommodation, in accordance with this invention, then user inputs 110 can be entered to effectuate this option. These may be entered at any time before printing begins, and may take the form of a simple selection of turning the limitation feature on or off.

Alternatively they may encompass any of a great variety of limitation parameters such as an absolute limit, a percentage limit, or a contingent limit based upon yet other operating conditions. Furthermore, combinations of these kinds of choices may be enabled.

The inputs 110 here control a branching function 114. If the limitation feature is turned off, then the weighted PAD error found in the analysis may be simply subject to a pass-through 115 to the next procedural step 121. If, however, the limitation is turned on, then one or various parameters selected are effectuated to first insert a limitation 116 to the possible range of values of the weighted PAD error.

In either event, the next step 121 is application of the determined PAD error to control the printer in printing an image.

5. Measurement Design and Reproducibility

Operation of the preferred embodiment described above is repeatable. At least the measurements of the test pattern are also accurate, to the extent that will be clear in this section.

Measurements conducted on HP papers (high-gloss photo paper type C6814A, coated paper type C6020B etc., and bright white inkjet paper type C6810A) show slight differences, but the measurements are generally stable. Pen and ink/media interactions produce the greatest variability.

Changes in the pen account for up to ±12 $\mu$m (3 sigma) of error (as seen on the high-gloss material). Ink/media interactions can cause up to ±10 $\mu$m (3 sigma) of error (as seen on the coated stock). The contribution of these two parameters can cause measurement errors as much as 0.5 DR (3 sigma) in the worst-case media/pen combination.

These observations arise from three tests performed to gauge measurement capability. The tests were designed to determine repeatability along the circumference of the roller, accuracy against reference templates, and measurement repeatability and reproducibility using the pens (HP's 80-C4820A series) developed for the preferred embodiment. Each test is outlined below.

(a) Measurement repeatability along the roller—This test was designed to ensure that roller eccentricities would not adversely impact PAD pattern measurements. The test was performed by repeatedly measuring image-setter reproductions at different points on the roller. An image-setter reproduction is an extremely accurate, mechanically stable reference template on Mylar® made using a photographic process.

This process was used to make a duplicate of the test pattern (FIG. 2), which was checked by Hewlett Packard's metrology department. Four such templates were used, each one having a "built-in" error (0, ¼, ½, ¾).

(b) Accuracy and Measurement Repeatability with templates—This test gauged the system accuracy and repeatability on an image-setter reference template. Each plot was measured ten times on five printers.

(c) Measurement Repeatability and Reproducibility with standard pens—This test gauged the system capability of measuring patterns produced with the standard pens for the preferred-embodiment product. There were two parts to this test.

In the first part the pattern was printed once and measured ten times. In the second part the pattern was printed and measured ten times. The test was done with each of three printing-media types, all Hewlett Packard standard papers for the product: high-gloss photo paper (component designator C6814A), coated paper (C6020B and related sizes), and bright white inkjet paper (C6810A).

Figure 9:
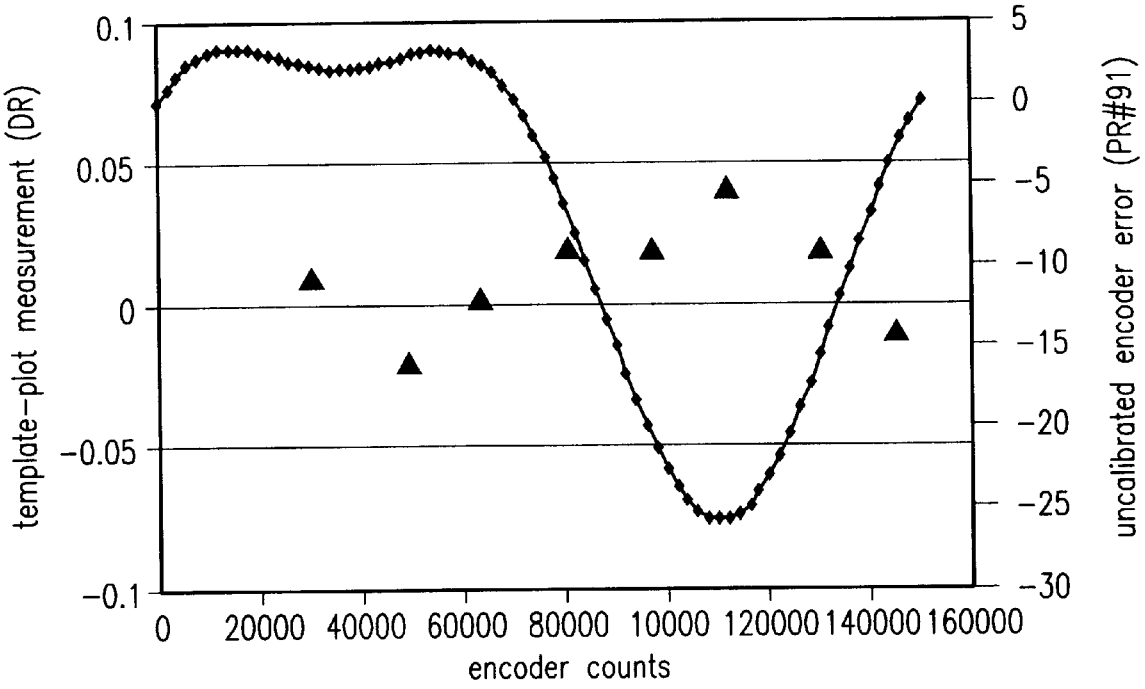
FIG. 9 is a graph of measurement repeatability, in accordance with the invention, along the circumference of a roller.

6. Measurement Results (a) Measurement repeatability along the roller—FIG. 9 shows the measurement (large triangles) of an image-setter reference template (zero error) along the circumference of the roller. The uncalibrated eccentricity (small diamonds) of this printer is shown in the graph, only to highlight where each measurement was made—although all the measurements were taken on a fully calibrated printer.

If the algorithm did not compensate adequately for PAD errors, measurements between 80,000 and 130,000 EU would have significant errors. As this graph shows, the measurements are stable on any point on the roller. Maximum variability is within 0.05 DR.

Figure 10:
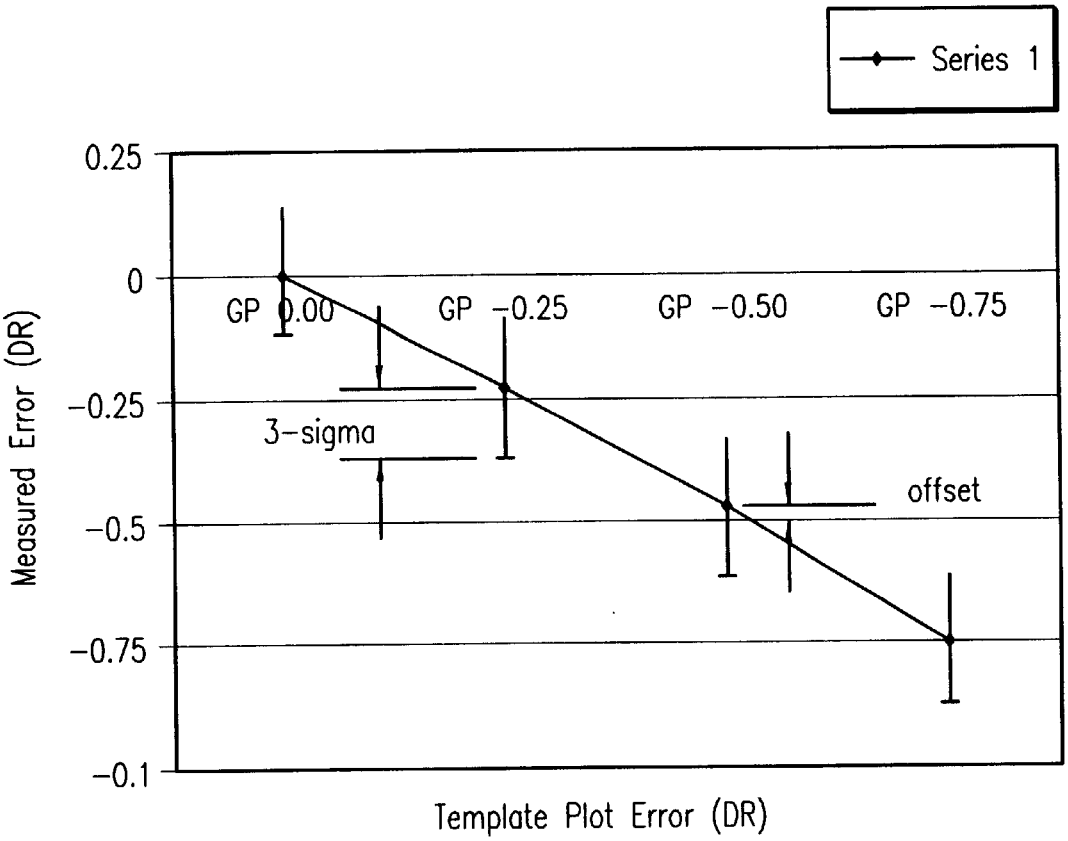
FIG. 10 is a graph of template-plot measurements with PR printers.

(b) Accuracy and measurement repeatability with reference templates—The variation and accuracy (FIG. 10) obtained with the templates show that the printer is capable of measuring the patterns well. The maximum measurement offset is 0.04 DR, i.e. only about 1/25 of one pixel row, with a 3-sigma variation of 0.15 DR.

Figure 11:
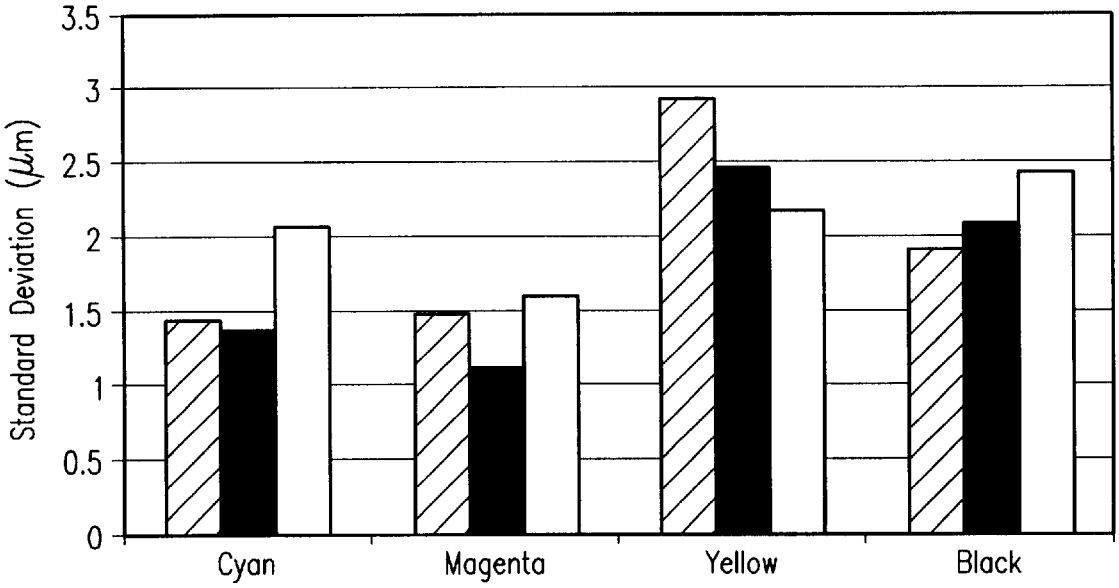
FIGS. 11 and 12 are both graphs of measurement reproducibility—corresponding to two different tests described in the text—for three printing media: within each triad of bars, the left-hand bar is for "bright white inkjet paper", the center bar for "coated paper", and the right-hand bar for "glossy paper"

(c) Measurement repeatability and reproducibility with standard pens—Repeatability of the measurements performed on patterns printed with the standard pens for use with the product that is a preferred embodiment of the invention, on the different media mentioned earlier, appears in FIG. 11. The measurement results are shown in groups of three bars, each group representing from left to right "bright white", "coated" and "glossy" paper. As mentioned earlier, this test was done by repeatedly measuring one pattern for each media ten times.

As can be seen, the measurements performed with the yellow pen exhibits the largest variation. This variation is seen on HP's "bright white inkjet paper" and has a standard deviation of 2.9 μm (0.07 DR). The 3-sigma variation is thus 8.7 μm (0.2 DR).

Figure 12:
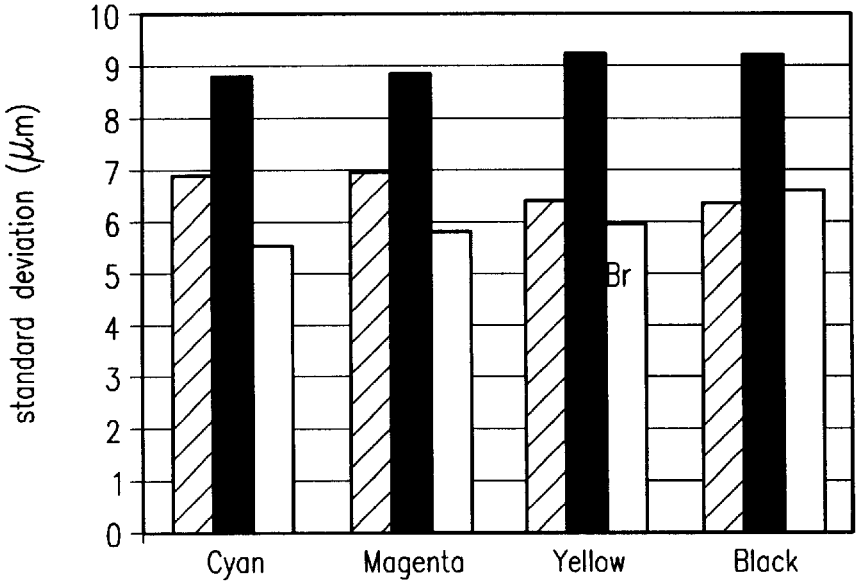

The largest variation of all tests conducted was obtained in a test (FIG. 12) of patterns printed and measured ten times for each medium. Variations on the coated paper are the largest of these—most likely due to the pens and ink/media interactions.

The yellow pen has the largest variation at 9.3 μm (0.2 DR), with a 3-sigma variation of 28 μm (0.7 DR). Variations on the high-gloss paper are mostly pen related. The largest is 9.2 μm (0.2 DR) with the black pen, with 3-sigma variation of 28 μm (0.7 DR).

The maximum allowed correction due to the line length spec is ±35 μm. As shown above, measurement capability (at the worst-case condition) is ±21 μm (3 sigma).

Figure 13:
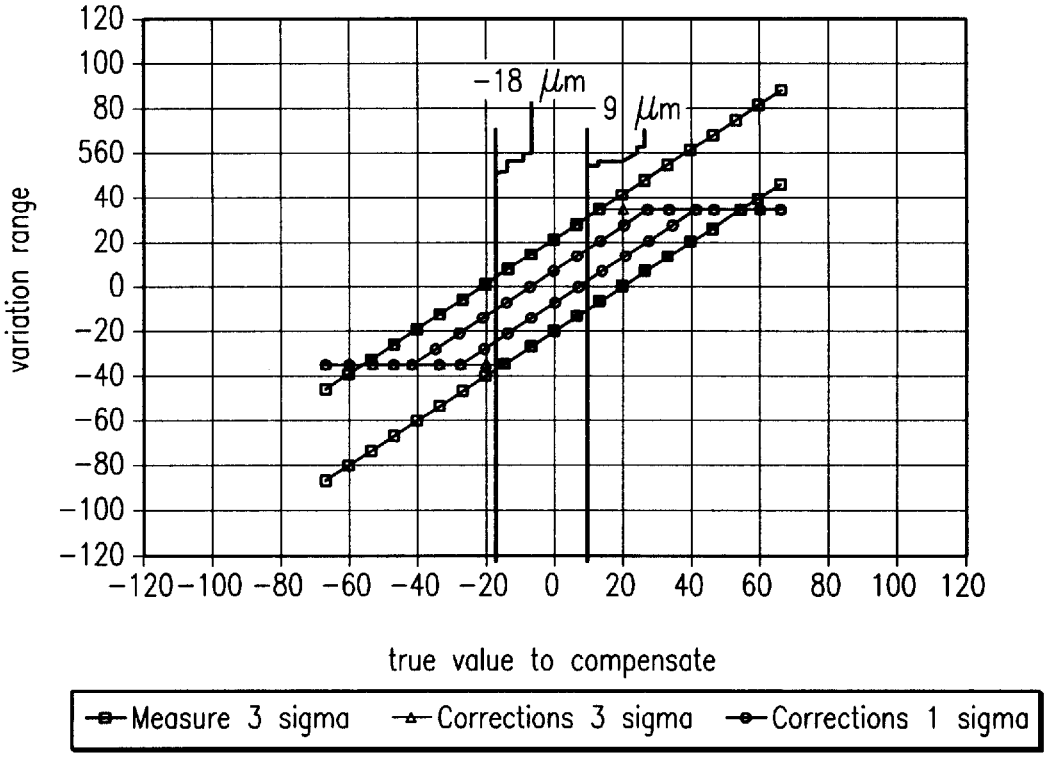
FIG. 13 is a graph of capability to correct for errors.

FIG. 13 shows the current capability of the system to correct for errors. For example, if the error to be corrected (true value) is −18 μm (i.e. along the left-hand vertical line marked in the graph), the measurement can vary between −39 μm and +3 μm (3 sigma).

The applied accommodation can vary from −35 μm to +3 μm. This example is a 3-sigma condition (values can range between the top and bottom angled extrema lines, with the worst-case media).

Considering the other example of a true value at 9 μm (right-hand vertical line marked in the graph) and a one-sigma variation (67% of the population), the variation would be from 16 μm to 2 μm. (Here values can range only between the two internal angled lines.)

Acceptable envelopes such as those defined by the angled lines in FIG. 13 define how much correction may be permissible if invoking the accommodation-limiting aspects of the invention. In particular, for example a line-length accuracy of +0.2% may be deemed the coarsest acceptable value, and if desired the adjustments to accommodate PAD error may be limited to such a value as discussed elsewhere in this document.

Such limitation may be imposed in any of a very great variety of ways, including a user's selection of an "on" or "off" condition for the limitation feature, or defining of a limitation on a finely graduated scale, or selection as between plural factory-established limitation values, or selection from a menu of Boolean conditions for application of one or more such values.

A graphical user interface may be provided for this and other user options introduced in this document, or physical control-panel settings may be enabled instead. Those skilled in the art will recognize yet other ways in which such limitation can be beneficially utilized and implemented.

Figure 14:
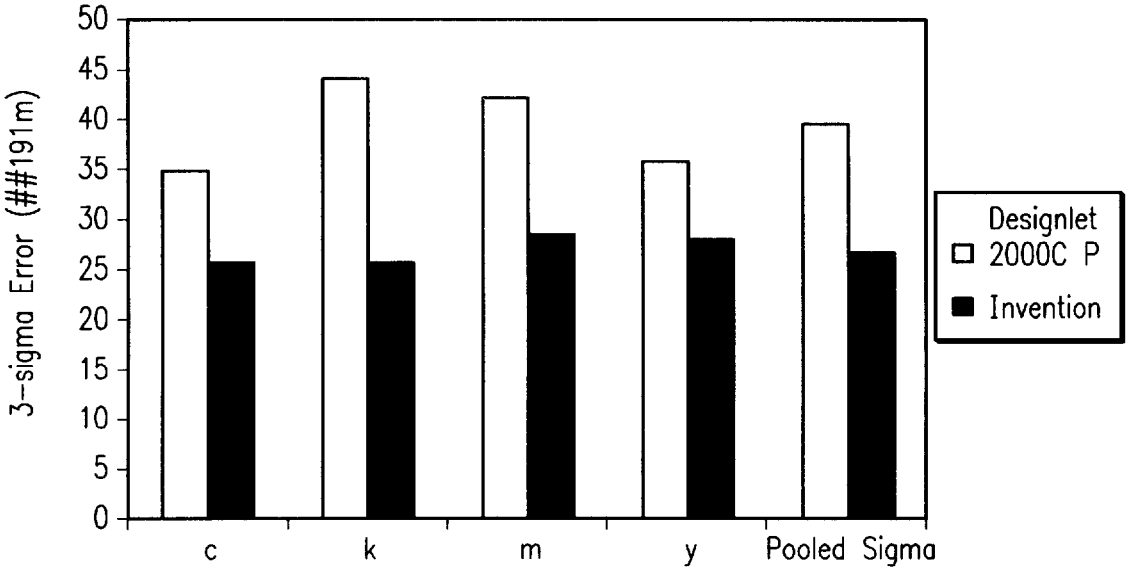
FIG. 14 is a comparative graph of performance for the present invention vs. the DesignJet 2000CP.

(d) Product comparison—Measurements (FIG. 14) made using the present invention and those made in a prior product, such as the DesignJet 2000CP mentioned earlier, show the improvement provided by the present invention. Although the comparison is at least partly academic, it may be of interest.

The comparison is between two randomly chosen printers, one of each product. Because the printed swath is much larger in the preferred embodiment of the present invention, the data have been normalized to 2½ cm (one inch), at 24 dot/mm (600 dpi).

In other words both PAD factors are converted to error for a theoretical 2½ cm swath. Considering the pooled sigma, measurements with the current printer exhibit half the error of those performed in the DesignJet 2000CP.

7. Conclusions and Further Developments

A printer is capable of measuring the patterns well; however, pen and media can cause variations (see table below). Changes in the pen while printing account for ±12 μm (3 sigma) of error on average (as seen on high-gloss photo-style media, Hewlett Packard's type C6814A).

Media interactions can cause ±10 μm (3 sigma) of error on average (as seen on coated media, e.g. Hewlett Packard's C6020B), and subtracting the pen contribution). The contributions of these two parameters can cause measurement errors as much as ±21 μm (0.5 DR, 3 sigma) in the worst-case media/pen combination.

| printing medium (HP) | reproducibility (μm) | repeatability (μm) | delta (μm) | 3 sigma (μm) | 3 sigma (DR) |
|---|---|---|---|---|---|
| high-gloss photo | 6.0 | 2.1 | 3.9 | 11.7 | 0.28 |
| coated | 9.0 | 1.8 | 7.2 | 21.6 | 0.51 |

With now-preferred embodiments of the present invention, extreme error values can be accommodated adequately. Low and midrange errors on coated media can be accommodated but only inaccurately, due to the variations outlined above (pen and ink/media). Unfortunately, these errors are exhibited in low-pass print modes, which further exacerbates the problem.

Tests suggest that refill issues at 12 kHz may cause some of the pen variations. This can be explored further by examining variations when firing at reduced duty cycles.

Additionally, due to printmode changes, it is helpful to review the nozzles used to create the end blocks in the alignment pattern—in particular, to select slightly more-inboard nozzles. This should also help reproducibility because inboard nozzles tend to be more stable than the outer ones.

In order to make the algorithm more robust in the small-error range, it is helpful to increase the value at which a measurement is considered good—for instance from 5 $\mu$m to 7 $\mu$m. Correspondingly, PAD factors falling within a range of 1±0.000401 can be changed to one.

Interlaced and repeated patterns are preferably provided for measuring misalignments. To minimize the effects of scan-axis servo errors and sampling errors, and to improve final measurement accuracy, the invention uses a special technique that includes measuring the same magnitude many times and making all the measurements relative (rather than absolute).

Figure 15:
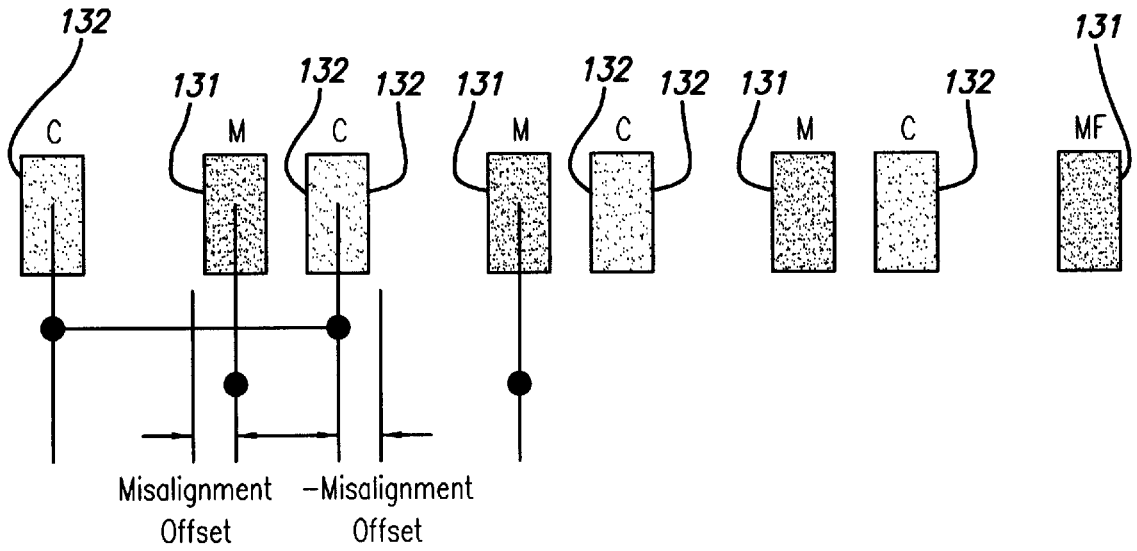
FIG. 15 is a diagram, somewhat schematic, showing test-pattern bars printed with two colorants to provide relative rather than absolute scan-axis alignment measurements.

For example, if it is desired to measure misalignment in the scan axis between magenta and cyan, the pattern is as shown in FIG. 15. These measurements are all relative.

The mean between two block centers is always compared to another block center in a group of three. (In these scan-axis test patterns, analogously to the medium-advance test pattern of FIG. 6, the center block 131 is always magenta.)

Outer blocks 132 are in all colors including magenta. This measurement is repeated many times along the scan axis or the media-advance axis to minimize the effect of localized problems and to reduce the noise in the measurement.

The above disclosure is intended as merely exemplary, and not to limit the scope of the invention—which is to be determined by reference to the appended claims.

What is claimed is:

1. An incremental printer for forming an image on a printing medium; said printer comprising:

plural printheads each marking a swath on such medium to cooperatively form an image portion, each head being subject to directional error that alters its swath length;

first portions of at least one processor operating each head to print swaths of a test pattern onto such medium;

an optical sensor reading the test pattern;

second portions of at least one processor analyzing sensor signals to measure, for each head, two values:

the swath length, and relative spacing of the swaths; and said second processor portions also comparing, for each head, the swath length against the relative spacing, to find the directional error for that head; and said second processor portions also comparing, for at least one head, the directional error against a predetermined limit representing a selected coarsest-acceptable line-length accuracy.

2. The printer of claim 1, wherein the selected coarsest-acceptable line-length accuracy is ±0.2%.

3. The printer of claim 1, further comprising:

third portions of at least one processor automatically applying the directional error, but limited by said selected coarsest-acceptable line-length accuracy, to control subsequent operation of the printer.

4. An incremental printer for forming an image on a printing medium; said printer comprising:

plural printheads each marking a swath on such medium to cooperatively form an image portion, each head being subject to directional error that alters its swath length;

first portions of at least one processor operating each head for printing swaths of a test pattern onto such medium;

an optical sensor reading the test pattern;

a print-medium advance mechanism, used in said printing and in said reading, that is subject to cyclical disturbances; said advance mechanism having a disturbance-compensating automatic calibration that is active in said printing but not in said reading;

second portions of at least one processor analyzing sensor signals to measure, for each head, two values:

the swath length, and relative spacing of the swaths;

said second processor portions also comparing, for each head, the swath length and the relative spacing, to find at least one directional error for the heads; and third processor portions for correcting, based upon said known cyclical disturbances, (1) signals from the optical sensor, or (2) the measured length or spacing, or (3) the directional error.

5. A method of operating an incremental printer that forms an image on a printing medium by operating plural printheads to each mark a swath on such medium to cooperatively form an image portion, each head being subject to directional error that alters its swath length; said method comprising the steps of:

reading a nonvolatile memory to retrieve, or operating an application-specific integrated circuit to effectuate, instructions for all of the remaining steps;

operating each head to print plural swaths of a test pattern onto the medium;

operating an optical sensor to read the test pattern;

analyzing sensor signals to measure, for each head, two values:

the swath length, and relative spacing of the swaths;

comparing, for each head, the swath length against the spacing, to find the directional error for that head;

wherein said analyzing and comparing steps comprise selecting nozzles for use in printing blocks of said test pattern, or selecting blocks of said test pattern for use in analysis and comparison, to enable at least one operating option chosen from these options:

control of a PAD characteristic for use in defining how to accommodate pen-nozzle directionality, obtaining a PAD factor profile throughout length of a pen, obtaining a PAD factor profile to capture problematic behavior in a particular part of a pen, tailoring PAD adjustments to a desired print-mode, and investigating pen operation at different frequencies or in different frequency ranges.

6. The method of claim 5, further comprising the step of:

accepting a user input for selection of one the operating options.

7. The method of claim 6, wherein the weighted-average finding step comprises:

weighting the directional error for each head in proportion to usage of each head respectively, to find said weighted average.

8. The method of claim 6, wherein:

the head-operating step comprises adjusting the printing-medium advance to accommodate previously found weighted average error; and the analyzing, comparing and finding steps collectively comprise making a correction for said adjusting.

9. A method of operating an incremental printer that forms an image on a printing medium by operating plural printheads to each mark a swath on such medium to cooperatively form an image portion, each head being subject to directional error that alters its swath length; said method comprising the steps of:

reading a nonvolatile memory to retrieve, or operating an application-specific integrated circuit to effectuate, instructions for all of the remaining steps;

operating each head for printing on the medium plural swaths of a test pattern, said operating step comprising adjustment of printing-medium advance to compensate in said printing for previously found mechanical errors;

operating an optical sensor to read the test pattern;

analyzing sensor signals to measure, for each head, two values:

the swath length, and relative spacing of the plural swaths; and comparing, for at least one head, the swath length and the relative spacing, to find a directional error;

said analyzing and comparing steps collectively comprising compensating said signals, values, or print-medium-axis directional errors for said mechanical errors.

10. The method of claim 9, wherein:

said correction-making step comprises correcting said relative spacing of the plural swaths.

* * * * *